United States Patent [19]

Hintsch

[11] Patent Number: 4,635,684

[45] Date of Patent: Jan. 13, 1987

[54] TORSION BAR MOUNTING FOR A PROJECTILE WEAVING MACHINE

[75] Inventor: Otto Hintsch, Wallisellen, Switzerland

[73] Assignee: Sulzer Brothers Ltd., Winterthur, Switzerland

[21] Appl. No.: 795,429

[22] Filed: Nov. 6, 1985

[30] Foreign Application Priority Data

Nov. 13, 1984 [EP] European Pat. Off. ..... 84113679.9

[51] Int. Cl.[4] ..... D03J 1/00

[52] U.S. Cl. ..... 139/1 R; 139/145; 184/6.2; 184/6.22

[58] Field of Search ..... 139/1 R, 45, 439, 145; 184/6.2, 55 R, 6.22, 6.24

[56] References Cited

U.S. PATENT DOCUMENTS

| | | | |
|---|---|---|---|
| 3,124,168 | 3/1964 | Wohlgemuth et al. | 139/145 |
| 4,205,708 | 6/1980 | Burgbacher | 139/45 |
| 4,444,292 | 4/1984 | Brown et al. | 184/6.22 |
| 4,448,285 | 5/1984 | Burgbacher | 184/55 R |
| 4,520,848 | 6/1985 | Lucian et al. | 139/1 R |

*Primary Examiner*—Henry S. Jaudon

*Attorney, Agent, or Firm*—Kenyon & Kenyon

[57] ABSTRACT

The projectile weaving machine is provided with a torsion bar arrangement wherein oil is delivered to a central part of the torsion bar during operation. The oil circuit includes an oil entry in or near the torsion bar mounting and an annular chamber which is defined by a casing part about the torsion bar. A cooler is also provided in the oil circuit for cooling of the oil and the hydraulic brake assembly for the torsion bar is incorporated in the oil circuit.

16 Claims, 4 Drawing Figures

TORSION BAR MOUNTING FOR A PROJECTILE WEAVING MACHINE

This invention relates to a torsion bar mounting for a projectile weaving machine. More particularly, this invention relates to an oil circuit for a torsion bar mounting of a projectile weaving machine.

Heretofore, it has been known to construct projectile weaving machines with a torsion bar for delivering energy for the picking of a projectile across the width of the weaving machine. Generally, the torsion bar carries a picking lever at a free end for the picking of a projectile while being actuated via a means which twists or imparts torsion to the bar prior to each pick. In such cases, the torsion bar has been secured in a mounting at one end on the weaving machine.

In many cases, projectile weaving machines of this type, for example as described in Swiss Pat. No. 320,682, have a separate casing for the torsion bar mounting which is provided with an oil or grease filling for lubrication purposes. However, one disadvantage of such a construction is that the torsion bar is subjected to differential heating. For example, temperatures of 20° to 25° C. may be found at the mounting while temperatures of 80° to 90° C. are found at the picking end. Because of these extreme temperature differences, corrosion may occur on the unlubricated central part of the torsion bar.

Accordingly, it is an object to obviate corrosion of a torsion bar of a projectile weaving machine during use.

It is another object of the invention to reduce the risk of breakage of a torsion bar of a projectile weaving machine during use.

It is another object of the invention to lubricate and cool the central portion of a torsion bar of a projectile weaving machine in a relatively simple and economical manner.

Briefly, the invention provides a projectile weaving machine having a torsion bar for picking a projectile across a shed within the machine and a mounting for connecting the torsion bar to the machine with a means for supplying oil to at least an end zone of the torsion bar at the mounting. The oil supply means permits the torsion bar to be cooled and lubricated uniformly so that corrosion and extreme temperature differences from one end of the bar to the other end are obviated. This, in turn, leads to a considerable increase in the working life of the torsion bar.

The torsion bar arrangement is further provided with a casing part which is connected to and which extends from the mounting in spaced relation to the torsion bar in order to define an annular chamber therewith. In addition, an oil inlet is provided in the mounting to receive a flow of oil while an oil passage is disposed between the mounting and the casing part in order to communicate the oil port with the annular chamber. Still further, an oil circuit extends from the outlet of the annular chamber to the oil port for circulating the oil through the arrangement. In this way, a continuous lubrication and/or cooling of torsion bar is ensured.

The weaving machine may also be provided with a casing to which the casing part is secured and through which the torsion bar passes with a picking lever secured to a free end of the torsion bar outside the casing. In addition, means are connected to the bar between the ends of the bar within the casing for twisting the torsion bar about a longitudinal axis. This means may also cooperate with a hydraulic brake means within the casing and within the oil circuit for braking of the torsion bar during a return stroke. One advantage of this arrangement is that the oil in the brake means can be used to lubricate and cool the torsion bar.

The oil circuit may also include a cooler in the oil circuit for cooling a flow of oil passing therethrough. This ensures that the oil on the torsion bar is at an optimal temperature.

Still further, a tubular extension piece may extend around the torsion bar within the casing in order to define a passage in communication with the annular chamber defined by the casing part for the flow of oil. This has the advantage of ensuring a very favorable flow of oil around the torsion bar with optimal cooling. An outlet of this extension piece also communicates with the interior of the casing so that the oil may be recycled through the oil circuit.

The oil circuit may also include a pump for circulating the flow of oil through the circuit. This provides a very effective heat transfer where the oil is passed through a cooler. In addition, the pump may be connected to a main shaft of the weaving machine.

In order to provide a very compact oil cooling structure, the cooler may be in the form of a box-section beam which extends across the weaving machine.

These and other objects and advantages of the invention will become more apparent from the following detailed description taken in conjunction with the accompanied drawings wherein.

Figure 1:
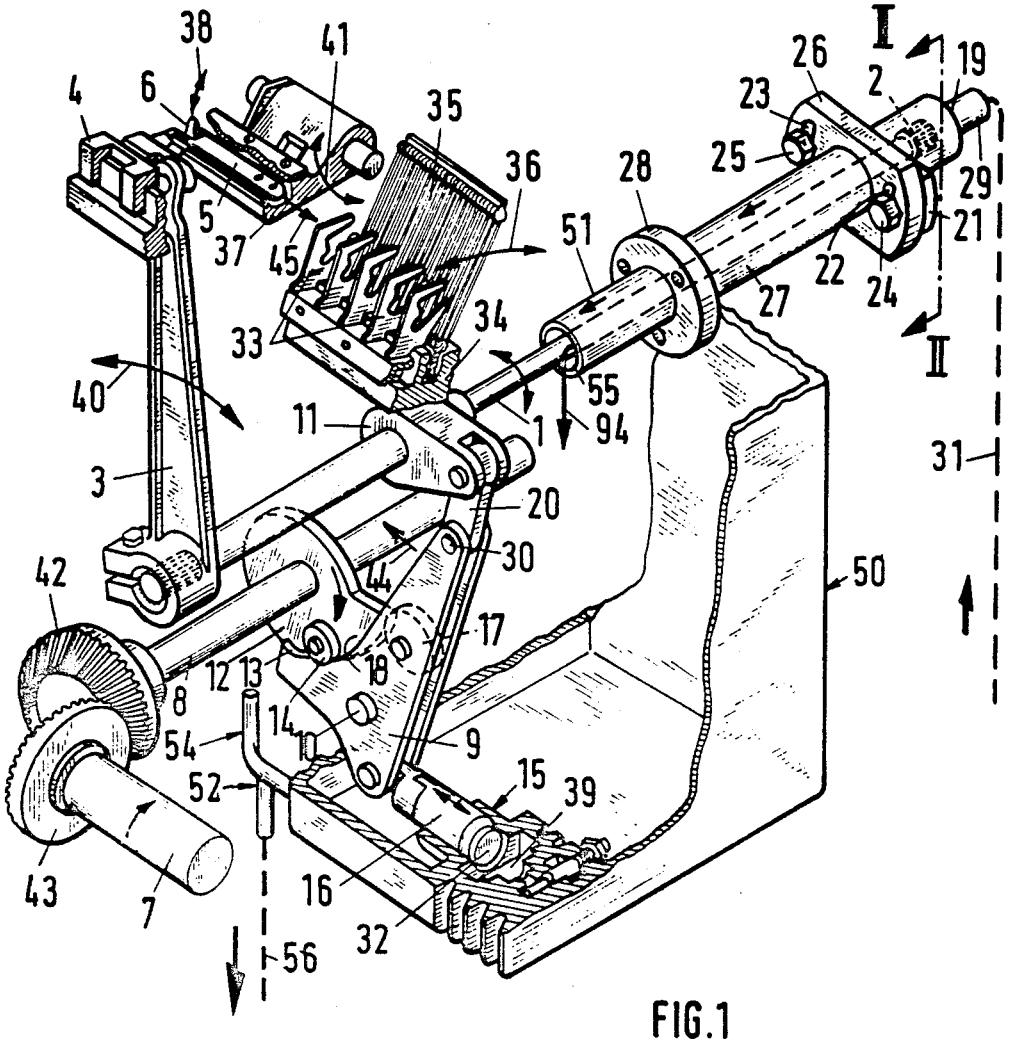
FIG. 1 illustrates a perspective view through a projectile weaving machine constructed in accordance with the invention.
Figure 3:
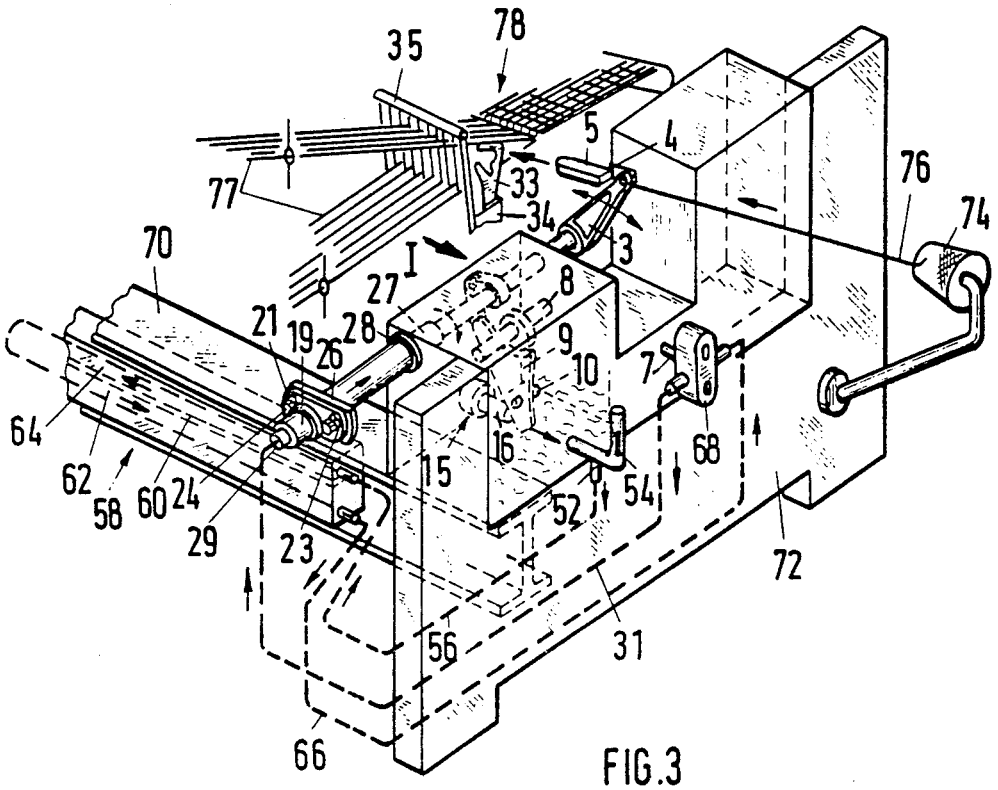
FIG. 3 illustrates a perspective view of an oil circuit employing an oil cooler and circulating pump in accordance with the invention.

Referring to FIGS. 1 and 3, the weaving machine has a torsion bar 1 which carries a picking lever 3 at a free end for the picking of a projectile 5 across a shed of warp yarns within the weaving machine. The torsion bar 1 extends through a casing 50 and has a toothed head 2 at an end opposite the picking lever 3.

Figure 2:
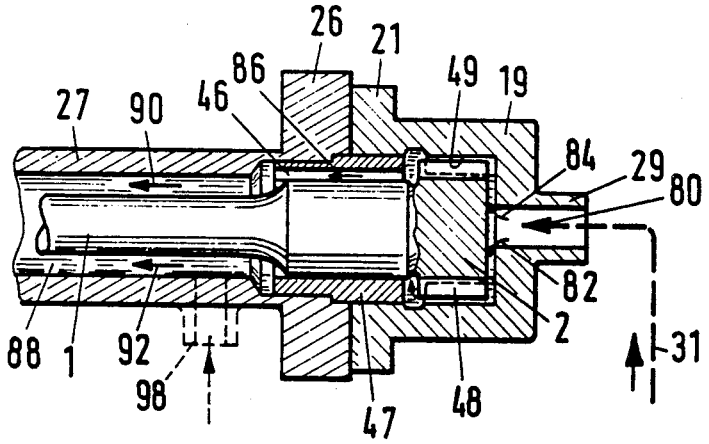
FIG. 2 illustrates an enlarged detail view of a torsion bar and mounting taken at line II—II of FIG. 1.

Referring to FIGS. 1 and 2, means are provided for connecting the toothed end of the torsion bar 1 to the casing 50 in order to permit twisting of the bar 1 relative to the casing 50 during picking of the projectile 5. This means includes a mounting 19 which is secured to the head 2 of the torsion bar 1 and a casing part 27 which extends between the mounting 19 and the casing 50 in order to define an annular chamber 88 about the torsion bar 1. As indicated in FIG. 2, the head 2 has a toothing 48 while the mounting 19 has a toothing 49. In both cases, the spaces between any two consecutive teeth in the toothings 48, 49 are, in known manner, twice the thickness of a single tooth. In order to produce the toothings 48, 49, every other tooth can be cut out of a complete circular tooth system. In this respect, the mounting 19 is able to rotate with the torsion bar 1.

In addition, the mounting 19 has a plate 21 which is adjustably secured to a flange 26 of the tubular casing part 27 by means of screws 24, 25 which are engaged in slots 22, 23 of the flange 26. The opposite end of the casing part 27 carries a flange 28 which is screwed to the casing 50 while a tubular extension piece 51 extends around the torsion bar 1 within the casing 50 in order to define a passage therebetween.

The mounting 19 also has an oil inlet 29 to receive a flow of oil from an oil line 31. As indicated in FIG. 2, a sleeve 47 is interposed between the torsion bar 1 and the plate 21 and flange 26 in order to permit relative rotation between the bar 1 and the sleeve 47. In addition, the sleeve 47 is provided with an axial passage which serves to communicate the oil port 29 with the annular chamber 88 between the casing part 27 and bar 1.

Referring to FIG. 1, the picking lever 3 is carried on the free end of the torsion bar 1 so as to reciprocate in the direction indicated by the arrow 40. In addition, the lever 3 carries a striker 4 which is pivotally mounted thereon and positioned to accelerate a projectile 5 through a projectile guide or channel 33 in the direction indicated by the arrow 45. As indicated, the projectile guide 33 is formed by a number of teeth which are disposed on a sley 34 in front of a reed 35. The sley 34, reed 35 and guide 33 pivot in a reciprocating fashion in the direction indicated by the arrow 36 while weaving is in progress so that a weft yarn picked into the shed via the projectile 5 is beaten up into a fabric.

As shown in FIG. 1, a shuttle lever 37 is adapted to pivot in a reciprocating manner as indicated by the arrow 41 in order to raise the projectile 5 into the illustrated position in which a yarn engaging clamp of the projectile 5 can be opened by an opener 6 which is adapted to pivot in a reciprocating manner in the direction indicated by the arrow 38.

A means is also connected to the torsion bar 1 between the ends thereof within the casing 50 for twisting the torsion bar 1 about a longitudinal axis. This means includes an arm 11 which is connected at an intermediate point of the bar 1 in order to rotate therewith. In addition, a link 20 is pivotally connected to the arm 11 and t o a lever 9 via a pivot pin 30. The lever 9 is constructed of two parts and is pivotally mounted on a pin 10 which is fixedly mounted in suitable manner within the casing 50. The lever 9 and link 20 form a toggle lever while the pivot 30 forms a toggle joint. In addition, the lever 9 carries a roller 17 which cooperates with a cam 12 secured on a shaft 8. This cam 12 carries a roller 14 which cooperates with a cam 13 on the lever 9.

The lever 9 is also pivotally connected to a piston 16 of a hydraulic brake means 15 which operates only when a front brake piston 32 is moving into a braking chamber 39, that is, when the picking weaver 3 has moved through a certain angle.

The shaft 8 carries a bevel gear 42 which meshes with another bevel gear 43 disposed on a main shaft 7 of the weaving machine. Thus, the main shaft 7 drives the shaft 8 and cam 12 continuously.

Referring to FIG. 3, a means is also provided for supplying oil to the end zone of the torsion bar 1 via the oil port 29 in the mounting 19. This means includes an oil circuit which is formed between an outlet 25 of the extension piece 21 and the oil port 29. In this regard, the interior of the casing 50 forms a part of the oil circuit.

As indicated in FIGS. 1 and 3, the oil circuit includes an oil outlet 52 from the casing 50 which connects to an oil line 56. In addition, an oil level indicator 54 is connected to the oil outlet 52 in order to indicate the level of oil within the casing 50. In addition, the oil circuit includes an oil cooler 58 which is connected to the oil line 56. As shown in FIG. 3, the cooler 58 has two chambers 62, 64 which are separated by a partition 60 and through which the oil from the line 56 passes for cooling purposes. Furthur, the cooler 58 is received in a bearer or beam 70 which is secured to an upright 72 of the weaving machine. The outlet side of the cooler 58 is connected to an oil line 66 which extends to a circulating pump 68 which is operatively connected to the main shaft 7 in order to be driven by the shaft 7. The outlet from the pump 68 is connected to the oil line 31 which extends to the oil port 29 in the mounting 19.

As shown in FIG. 3, a bobbin 74 for a weft yarn 76 is secured to the machine upright 72. This weft yarn 76 is supplied with a supply of warp yarns 77 within a shed to form a finished fabric 78 in known manner.

During operation of the weaving machine, the main shaft 7 drives the shaft 8 which passes into the casing 50. This in turn causes the cam 12 to rotate so that a protuberance 18 on the cam 12 engages the roller 17 on the lever 9 causing the lever 9 and associated parts to move into the illustrated position, that is, the extended or straight position of the toggle 9, 20. In this position, the torsion bar 1 has been twisted by way of the arm 11 relative to the fixed clamping station, that is relative to the flange 28 which is secured to the casing 50.

When the roller 14 on the cam 12 thereafter engages the cam 13, the toggle 9, 20 moves from the illustrated extended position in the direction indicated by the arrow 44 causing the toggle 9, 20 to bend so that the torsion bar 21 returns to a normal unstressed state. At this time, the picking lever 3 is pivoted to the right as viewed in FIG. 1 with the projectile 5 being shot or picked through the guide 33 and, therefore, through the shed (not shown). The weft yarn 76 is then in the process of being picked.

When the torsion bar 1 is twisted to a normal extent, the angle of rotation covered when returning to the normal state is so great that the brake means remains operative during the return rotation of the torsion bar 1.

During operation of the machine, oil is also passed by the lubricating system through the oil outlet 52 of the casing 3, the line 56, cooler 58, line 66, pump 68 and line 31 to the oil inlet 29 of the mounting 19 (see FIG. 3). From the oil inlet 29, the oil flows through the toothings 48, 49 in the directions indicated by the arrows 80, 82, 84 in FIG. 2 and then passes through the axial passage 46 in the sleeve 47 as indicated by the arrow 86 and to the annular chamber 88 between the bar 1 and the casing part 27 as indicated by the arrows 90, 92. Thereafter, the oil flows in the passage between the extension piece 51 and the bar 1 and exits from the outlet 55 in the direction indicated by the arrow 94 in FIG. 1 into the casing 50. During passage of the oil from the oil inlet 29 to the oil outlet 55, the torsion bar 1 is cooled or lubricated uniformly substantially over its whole length.

Of note, the oil which is heated by the torsion bar 1 is subsequently cooled during passage through the cooler 58. Thus, a continuous lubrication and/or cooling of the torsion bar 1 is carried out during operation of the weaving machine.

Figure 4:
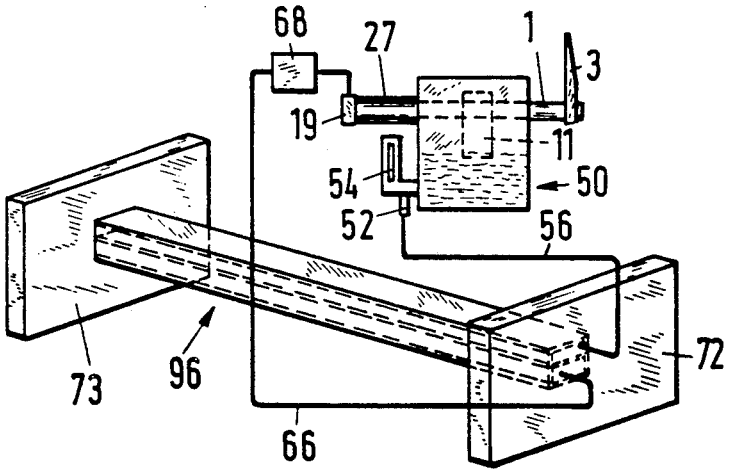
FIG. 4 illustrates an oil circuit having an oil cooler in the form of a box-section beam in accordance with the invention.

Referring to FIG. 4 wherein like reference characters indicate like parts as above, the oil cooler 96 may be in the form of a box-section beam or support member which extends across the weaving machine width and which is mounted directly between machine uprights 72, 73. The cooler 96 thus provides a bearing or support effect as well as a cooling effect. This feature helps to make the construction very compact.

As shown in dotted line of FIG. 2, an oil port 98 may be provided in the casing part 27 so that the oil can be directed directly into the annular chamber 88 so that the torsion bar 1 is adapted to receive oil at least in the region of the mounting 19.

The invention thus provides a projectile weaving machine with a torsion bar arrangement wherein the central part of the torsion bar can be lubricated and/or cooled. This permits the torsion bar to have a more uniform temperature so that corrosion and extreme temperature differences are obviated. This, in turn, leads to a considerable increase in the working life of the torsion bar.

What is claimed is:

1. In a projectile weaving machine, the combination comprising a torsion bar for picking a projectile across a shed within the machine;

a mounting for connecting said torsion bar to the machine to permit twisting of said bar about a longitudinal axis thereof during picking of a projectile; and means for supplying a flow of oil to at least one end zone of said torsion bar at said mounting to flow along said torsion bar.

2. In a projectile weaving machine, the combination comprising a torsion bar for picking a projectile across a shed within the machine;

a mounting for connecting said torsion bar to the machine to permit twisting of said bar about a longitudinal axis thereof during picking of a projectile;

a casing part connected to and extending from said mounting in spaced relation to said bar to define an annular chamber therewith; and means for supplying oil to at least one end zone of said torsion bar at said mounting, said means including an oil inlet in said mounting to receive a flow of oil, an oil passage between said mounting and said casing part to communicate said oil port with said annular chamber and an oil circuit extending from an outlet of said annular chamber to said oil port.

3. The combination as set forth in claim 2 which further comprises a hydraulic brake means within said oil circuit for braking of said torsion bar.

4. The combination as set forth in claim 2 which further comprises a cooler in said oil circuit for cooling a flow of oil passing therethrough.

5. The combination as set forth in claim 4 wherein said cooler includes a box-section beam extending across the weaving machine.

6. The combination as set forth in claim 2 wherein said casing part includes a tubular extension piece extending around said torsion bar to define a passage for the flow of oil.

7. The combination as set forth in claim 2 which further comprises a pump in said oil circuit for circulating a flow of oil through said circuit.

8. The combination as set forth in claim 7 wherein said pump is operatively connected to a main shaft of the weaving machine.

9. In a projectile weaving machine, the combination of a casing;

a torsion bar for picking a projectile across a shed within the machine;

means for connecting one end of said bar to said casing to permit twisting of said bar relative to said casing during picking of a projectile, said means including a mounting secured to said one end of said bar and a casing part between said mounting and said casing defining an annular chamber about said torsion bar; and means for supplying a flow of oil through said annular chamber about said torsion bar for cooling and lubricating said torsion bar.

10. The combination as set forth in claim 9 which further comprises a picking lever at a free end of said torsion bar for striking a projectile and means connected to said bar between said ends and within said casing for twisting said torsion bar about a longitudinal axix thereof.

11. The combination as set forth in claim 9 wherein said means for supplying oil includes an oil inlet in said mounting to receive a flow of oil and an oil passage between said mounting and said casing part to communicate said oil port with said annular chamber.

12. The combination as set forth in claim 11 which further comprises a tubular extension piece extending around said torsion bar within said casing to define a passage in communication with said annular chamber for the flow of oil.

13. The combination as set forth in claim 12 which further comprises an oil circuit extending from an outlet of said extension piece to said oil port.

14. The combination as set forth in claim 13 which further comprises a hydraulic brake means within said oil circuit for braking of said torsion bar.

15. The combination as set forth in claim 13 which further comprises a cooler in said oil circuit for cooling a flow of oil passing therethrough.

16. The combination as set forth in claim 13 which further comprises a pump in said oil circuit for circulating a flow of oil through said circuit.

* * * * *